US007273539B2

(12) United States Patent
Taunier et al.

(10) Patent No.: US 7,273,539 B2
(45) Date of Patent: Sep. 25, 2007

(54) METHOD FOR REGENERATION OF AN ELECTROLYSIS BATH FOR THE PRODUCTION OF A COMPOUND I-III-VI$_2$ IN THIN LAYERS

(75) Inventors: Stéphane Taunier, Paris (FR); Denis Guimard, Paris (FR); Daniel Lincot, Antony (FR); Jean-François Guillemoles, Paris (FR); Pierre-Philippe Grand, Reuil-Malmaison (FR)

(73) Assignees: Electricite de France, Paris (FR); Centre National de la Recherche Scientifique, Paris (FR)

( * ) Notice: Subject to any disclaimer, the term of this patent is extended or adjusted under 35 U.S.C. 154(b) by 0 days.

(21) Appl. No.: 10/540,731

(22) PCT Filed: Dec. 5, 2003

(86) PCT No.: PCT/FR03/03608

§ 371 (c)(1),
(2), (4) Date: Jun. 24, 2005

(87) PCT Pub. No.: WO2004/067809

PCT Pub. Date: Aug. 12, 2004

(65) Prior Publication Data

US 2006/0084196 A1 Apr. 20, 2006

(30) Foreign Application Priority Data

Dec. 26, 2002 (FR) ..... 02 16712

(51) Int. Cl.

| | |
|---|---|
| ***C25D 3/56*** | (2006.01) |
| ***C25D 3/58*** | (2006.01) |
| ***C25D 3/62*** | (2006.01) |
| ***C25D 21/18*** | (2006.01) |

(52) U.S. Cl. ..... 205/238; 205/239; 205/242; 205/247; 205/101

(58) Field of Classification Search ..... 205/239, 205/242, 247, 251, 101, 238
See application file for complete search history.

(56) References Cited

U.S. PATENT DOCUMENTS

| | | | |
|---|---|---|---|
| 4,253,919 | A | 3/1981 | Hall et al. |
| 4,687,559 | A | 8/1987 | Coburn et al. |
| 5,071,568 | A | 12/1991 | Bennett et al. |
| 5,510,040 | A | 4/1996 | Miller et al. |

OTHER PUBLICATIONS

Nakamura et al., "Composition Control of Electrodeposited Cu-In-Se layers for Thin Film CuInSe2 Preparation", Solar Energy Materials and Solar Cells, vol. 50 (no month, 1998), pp. 25-30.*

Wang et al., "X-ray Photoelectron Spectroscopic Study of the Adsorption of Selenium(IV) and Selenium(VI) in Solution by Sulfhydryl Cotton Fibers", Fenxi Huaxue (no month, 1982), vol. 10, No. 7, pp. 409-413. Abstract Only.*

(Continued)

*Primary Examiner*—Edna Wong
(74) *Attorney, Agent, or Firm*—Kilpatrick Stockton LLP

(57) ABSTRACT

The invention relates to the regeneration of an electrolysis bath for the production of I-III-VI<SB>Y</SB> compounds in thin layers, where y is approaching 2 and VI is an element including selenium, whereby selenium is regenerated in the form Se(IV) and/or with addition of oxygenated water to reoxidise the selenium in the bath to give the form Se(IV).

10 Claims, 1 Drawing Sheet

OTHER PUBLICATIONS

International Search Report May 12, 2005.
Shin'ichi Kuranouchi et al., "Study of One-Step Electrodeposition Condition for Preparation of CuIn(Se, S)$_2$ Thin Films", *Solar Energy Materials and Solar Cells 50*, (1998), pp. 31-36, no month.
Guillen et al., "Cathodic Electrodeposition of $CuInSe_2$ Thin Films", *Thin Solid Films*, 195(1991) January, pp. 137-146, Nos. 1/2, Lausanne, CH, no month.
Nakamura et al., "Composition Control of Electrodeposited Cu-In-Se Layers for Thin Film $CuInSe_2$ Preparation", *Solar Energy Materials and Solar Cells 50*, (1998), pp. 25-30, no month.

* cited by examiner

METHOD FOR REGENERATION OF AN ELECTROLYSIS BATH FOR THE PRODUCTION OF A COMPOUND I-III-$VI_2$ IN THIN LAYERS

FIELD OF INVENTION

The present invention relates to the production of semiconductors of the I-III-$VI_2$ type in thin film form, especially for the design of solar cells.

BACKGROUND OF THE INVENTION

I-III-$VI_2$ compounds of the $CuIn_xGa_{(1-x)}Se_yS_{(2-y)}$ type (where x is substantially between 0 and 1 and y is substantially between 0 and 2) are regarded as very promising and could constitute the next generation of thin-film photovoltaic cells. These compounds have a wide direct bandgap of between 1.05 and 1.6 eV, which allows solar radiation in the visible to be strongly absorbed.

Record photovoltaic conversion efficiencies have been achieved by preparing thin films by evaporation on small areas. However, evaporation is difficult to adapt to the industrial scale because of problems of nonuniformity and low utilization of raw materials. Sputtering is better suited to large areas, but it requires very expensive vacuum equipment and precursor targets.

There is therefore a real need for alternative, low-cost atmospheric-pressure, techniques. The technique of thin-film deposition by electrochemistry, in particular by electrolysis, appears to be a very attractive alternative. The advantages of this deposition technique are numerous, and in particular the following:

- deposition at ambient temperature and ambient pressure in an electrolysis bath;
- possibility of handling large areas with high uniformity;
- ease of implementation;
- low installation and raw material costs (no special forming operation, high level of material utilization); and
- great variety of possible deposit shapes due to the localized nature of the deposit on the substrate.

Despite extensive research in this field, the difficulties encountered relate to the control of the quality of the electrodeposited precursors (composition and morphology) and the efficiency of the electrolysis bath after several successive depositions.

OBJECTS OF THE INVENTION

It is an object of the present invention to propose a method of producing thin films of a I-III-$VI_y$ compound (where y is close to 2) by electrolysis, which ensures that the deposition conditions are stable and reproducible.

A further object is to be able to carry out, over large areas, a large number of successive depositions of thin films having the desired morphology and the desired composition.

Another object of the present invention is to propose a method of producing thin films of the I-III-$VI_y$ compound, which ensures a satisfactory lifetime of the electrolysis bath and effective regeneration of the raw materials consumed during the electrolysis.

Another object of the present invention is to propose a method of producing thin films of the I-III-$VI_Y$ compound; which ensures that the raw materials consumed during the electrolysis are regenerated, without in any way causing the composition of the electrolysis bath to go out of equilibrium and therefore reducing its lifetime.

SUMMARY OF THE INVENTION

For this purpose, the subject of the invention is a method of producing a I-III-$VI_y$ compound in thin film form by electrochemistry, in which y is close to 2 and VI is an element comprising selenium, of the type comprising the following steps:

a) of providing an electrolysis bath comprising active selenium, in oxidation state IV, and at least two electrodes; and b) of applying a potential difference between the two electrodes in order to substantially promote migration of the active selenium toward one of the electrodes and thus initiate the formation of at least one thin film of I-III-$VI_Y$.

Within the context of the invention, the method furthermore includes a step c) of regenerating the selenium in active form in said bath, in order to increase the lifetime of said electrolysis bath.

Thus, within the context of the present invention, the method begins by regenerating the bath in terms of active selenium before regenerating it in terms of element I (such as copper) and/or element III (such as indium or gallium). This is because it has been found that a slight reintroduction of active selenium in the bath (preferably an excess of about 20% in molar concentration relative to the amount of selenium normally added) makes it possible again to obtain substantially the same number and the same volume of thin films as those obtained after step b).

Advantageously, after step c), at least one new thin film of I-III-$VI_Y$ is formed.

Thus, in a first embodiment, at step c), selenium is added to the bath in order to form an excess of active selenium in the bath.

In another embodiment, as a variant of or in addition to the aforementioned first embodiment, at step c), an oxidizing agent for selenium is introduced into the bath in order to regenerate selenium in active form.

Usually, the electrolysis bath, when it ages over the course of the deposition, has selenium colloids. This selenium in colloid form is in oxidation state 0 and, within the context of the present invention, is not capable of combining with the elements I and III.

Advantageously, if the bath contains selenium in colloid form at step b), the aforementioned oxidizing agent is capable of regenerating the selenium in colloid form to selenium in active form.

Thus, it will be understood that the expression "selenium in active form" means selenium in oxidation state IV, which is capable of being reduced at the electrode to the ionic form $SE^{2-}$ and of combining naturally with the elements I and III in order to form the thin films of I-III-$VI_Y$, and being distinguished from selenium in oxidation state 0, for example in the form of colloids in the solution of the bath, which does not combine with the elements I and III.

In a particularly advantageous embodiment, said oxidizing agent is hydrogen peroxide, preferably with a concentration in the bath of the order of magnitude corresponding substantially to at least five times the initial selenium concentration in the bath.

The addition of hydrogen peroxide to the bath therefore makes it possible to regenerate the electrolysis bath at very low cost. In addition, this regeneration is carried out without contaminating the bath since a simple degassing operation allows the initial constitution of the bath to be recovered.

In this regard, in which the electrolysis bath is regenerated by limiting its contamination by the regenerating additives, it is advantageous to provide a step after step c), of regenerating the electrolysis bath by introducing oxides and/or hydroxides of elements I and III.

BRIEF DESCRIPTION OF THE DRAWINGS

Other advantages and features of the invention will become apparent on reading the detailed description below of embodiments given by way of nonlimiting examples, and by examining the drawings which accompany it, in which.

DETAILED DESCRIPTION OF THE INVENTION

Figure 1:
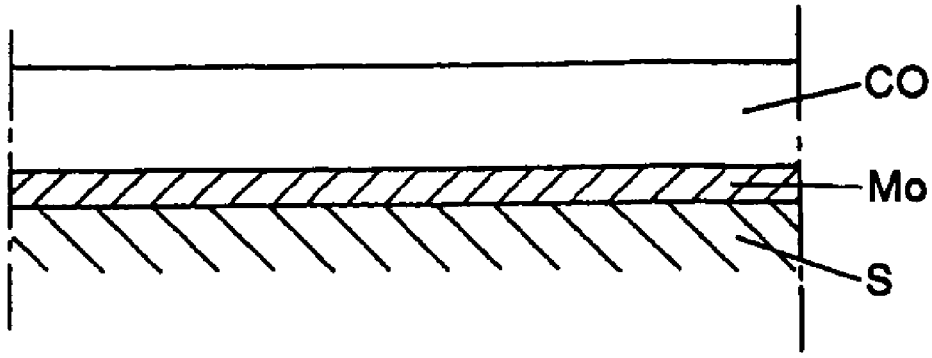
FIG. 1 shows schematically a thin film obtained by implementing the method according to the invention.

Referring to FIG. 1, copper indium diselenide films CO are obtained at room pressure and room temperature by electrodeposition of a thin precursor film of suitable composition and suitable morphology on a glass substrate S coated with molybdenum Mo. The term "precursor film" is understood to mean a thin layer of overall composition close to $CuInSe_2$ and obtained directly after deposition by electrolysis, without any subsequent treatment.

Figure 2:
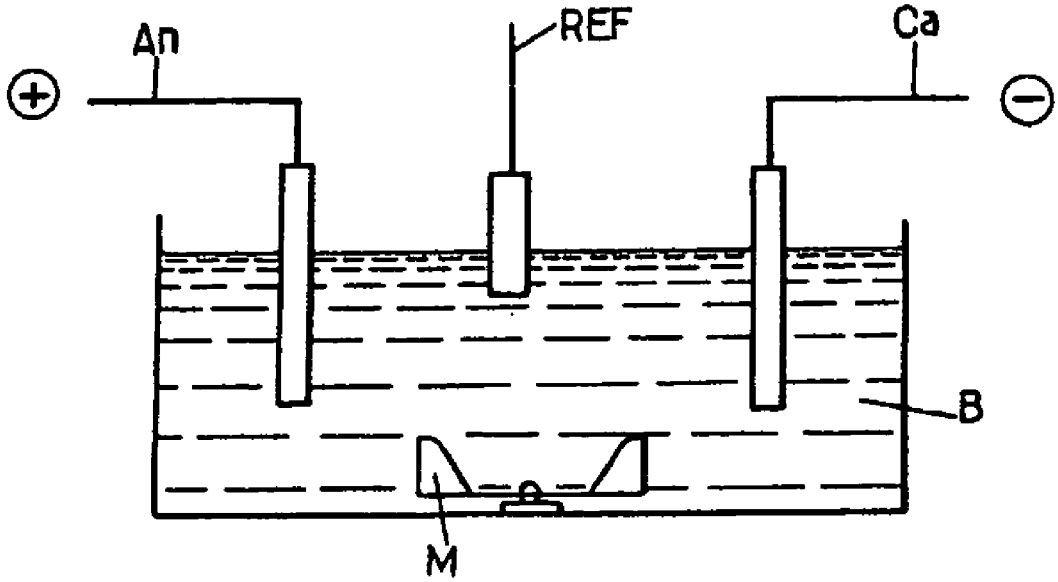
FIG. 2 shows schematically an electrolysis bath for implementing the method according to the invention.

The electrodeposition is carried out using an acid bath B (FIG. 2), stirred by blades M, which contains an indium salt, a copper salt and selenium oxide in solution. The concentrations of these precursor elements are between $10^{-4}$ and $10^{-2}$ M. The pH of the solution is set between 1 and 4.

Three electrodes, An, Ca and REF, including:

- a molybdenum electrode Ca (standing for cathode) on which the thin film forms by electrodeposition; and
- a mercurous sulfate reference electrode REF, are immersed in the bath B.

The electrical potential difference applied to the molybdenum electrode is between −0.8 and −1.2 V relative to the reference electrode REF.

Layers having a thickness of between 1 and 4 microns are obtained with current densities of between 0.5 and 10 $mA/cm^2$.

Under the defined composition, stirring and potential difference conditions, it is possible to obtain dense adherent films of homogeneous morphology, the composition of which is close to the stoichiometric composition: Cu (25%); In (25+ϵ %) and Se (50%), with a composition slightly richer in indium, as Table I below shows. It is thus possible to deposit films on areas of 10×10 $cm^2$.

An exemplary embodiment of the invention is given below.

A typical deposit was produced from a bath whose initial formulation was the following:

$[CuSO_4]=1.0\times10^{-3}$ M;

$[In_2(SO_4)_3]=3.0\times10^{-3}$ M;

$[H_2SeO_3]=1.7\times7.10^{-3}$ M;

$[Na_2SO_4]=0.1$ M, where the notation "M" corresponds to the unit "mole per liter", for a pH of 2.2.

The precursors were deposited by a cathodic reaction for a set potential of −1 V relative to the electrode REF. The current density was −1 $mA/cm^2$.

After each electrolysis, the bath was recharged with elements Cu, In and Se on the basis of the number of coulombs indicated by a detection cell (not shown) which thus counts the number of ions that are interacted with the solution of the bath. This recharging allowed the concentration of the elements to be kept constant over the course of the successive electrodeposition operations. The pH could also be readjusted by adding sodium hydroxide (such as NaOH, for a concentration such as 1 M), but this measure is not systematically necessary here, as will be seen later.

Under these conditions, it was usually found that, after an indication of 500±100 coulombs in a 1-liter solution (corresponding to the electrodeposition of 4 to 5 thin films of 25 $cm^2$ area with a thickness of 2 μm), partial or complete debonding of the $CuInSe_2$ films systematically occurs.

According to the invention, this debonding disappeared by regenerating the bath with selenium, before even regenerating the elements Cu and In.

A distinction should be made here between active selenium of oxidation state IV, usually denoted Se(IV), and inactive selenium, in oxidation state 0, which is generally observed in the form of colloids in the electrolysis bath and usually denoted by Se(0).

It should be pointed out that it is only active selenium Se(IV) that is capable of being reduced at the electrode Ca to the ionic form $Se^{2-}$ and of being combined, in this form, with the elements Cu and In to form the thin films of $CuInSe_2$.

It should also be pointed out that there are two competitive reactions during the electrolysis: the selenium introduced into the bath can be converted at the electrode:

- either into $Se^{2-}$ favorable to the formation of the thin films as indicated above;
- or to Se(0) in colloid form, which is not favorable to the formation of thin films, especially because the colloids pose problems at the interface between the substrate (or the molybdenum layer MO here) and the thin Cu—In—Se film being formed.

Advantageously, regeneration is carried out with an excess of Se(IV) in the bath. For this purpose, selenium oxide is added, dissolved in the electrolysis bath, in order to slow down the ageing of the bath. In practice, for a thin film formed and 115 coulombs passing through the solution, it is theoretically necessary to add $1.8\times10^{-4}$ M of $[H_2SeO_3]$ to the solution in order to have an initial selenium concentration of $1.7\times10^{-3}$ M again. An addition of twice this amount (i.e. $3.6\times10^{-4}$ M and therefore an excess of $1.8\times10^{-4}$ M of $[H_2SeO_3]$), at the fifth deposition, makes it possible to obtain adherent films again. These thin films have the desired morphology and the desired composition (Table I). An over-regeneration of $3.6\times10^{-4}$ M thus makes it possible to obtain a cycle of 4 to 5 films of satisfactory adhesion before further debonding problems are observed. After each debonding cycle, the renewal of this operation allows adherent films to be obtained.

As a variant of or in addition to this operation, an oxidizing agent for reoxidizing the selenium in Se(0) form is used in order to obtain selenium in Se(IV) form. For this purpose, it is preferred to use hydrogen peroxide $H_2O_2$, employing $H_2O_2$ in large excess in the solution (concentration of the order of $10^{-2}$ M, preferably close to $4\times10^{-2}$ M). The films become adherent again for 4 to 5 successive thin-film deposition operations, before they become debonded again. The renewal of this operation also makes it possible to obtain adherent films again. Advantageously, it has been observed that the addition of hydrogen peroxide furthermore makes it possible to obtain thin films of relatively smoother morphology.

Thus, it has been found that there is a great similarity between the effects provided by Se(IV) over-regeneration and $H_2O_2$ addition to the solution. It may also be pointed out that other types of oxidizing agent than hydrogen peroxide, especially ozone $O_3$, may be used in order to increase the lifetime of the baths.

The composition (Table I) and the morphology of the films are substantially the same as when hydrogen peroxide was added to the bath or when selenium (IV) was regenerated.

TABLE I

Comparative analysis of the composition of the thin electrodeposited $CuInSe_2$ films as a function of excess selenium Se(IV) over-regeneration and addition of hydrogen peroxide.

| | Cu (%) | In (%) | Se (%) |
|---|---|---|---|
| First deposit | 21.4 | 27.5 | 51 |
| Addition of $H_2O_2$ | 22.9 | 25 | 52 |
| Excess regeneration of Se(IV) | 21.4 | 28.8 | 49.7 |

The addition of hydrogen peroxide or the excess regeneration of Se(IV) makes it possible to considerably increase the number of films that can be deposited with one bath. Such recycling of the bath makes it possible for the elements introduced, and more particularly the indium, to be entirely consumed by electrolysis. This makes it possible, particularly advantageously, to reduce the precursor production costs, especially compared with evaporation or sputtering methods.

It should be pointed out that, according to an advantageous aspect of the regeneration of the bath within the context of the invention, copper and/or indium oxides or hydroxides are also added in order to regenerate the $CuInSe_2$ electrolysis bath in terms of copper and/or indium.

For example, by adding copper oxide CuO and indium oxide $In_2O_3$ to the bath, the following reactions (1) and (2) occur:

$$CuO+H_2O \rightarrow Cu^{2+}+2OH^- \quad (1)$$

$$(1/2)In_2O_3+(3/2)H_2O \rightarrow In^{3+}+3OH^- \quad (2)$$

In contrast, if the compounds $CuSO_4$ and $In_2(SO_4)_3$ have been added, the bath would have been contaminated with $SO_4^{2-}$ sulfate ions.

Furthermore, the reaction to form $CuInSe_2$ at the cathode is written as:

$$Cu^{2+}+In^{3+}+2H_2SeO_3+8H^++13e^- \rightarrow CuInSe_2+6H_2O \quad (4)$$

where $e^-$ corresponds to an electron, whereas at the anode, the following reaction takes place:

$$(13/2)H_2O \rightarrow 13H^++(13/4)O_2+13e^- \quad (4)$$

in order to maintain charge equilibrium.

According to another advantage provided by the addition of Cu and In oxides, it has been found that the difference of five $H^+$ ions in excess between equations (3) and (4) is compensated for by the five $OH^-$ ions introduced by the reactions (1) and (2). Thus it will be understood that the addition of Cu and In oxides furthermore makes it possible to stabilize the pH of the solution and to dispense with the addition of sodium hydroxide as mentioned above.

It may furthermore be pointed out that the addition of hydroxides $Cu(OH)_2$ and $In(OH)_3$ produces the same effects, the reactions (1) and (2) becoming simply:

$$Cu(OH)_2 \rightarrow Cu^{2+}+2OH^- \quad (1')$$

$$In(OH)_3 In^{3+}+3OH^- \quad (2')$$

Thus, the longevity and stability of the baths for electrodepositing I-III-$VI_y$ compounds such as Cu—In—$Se_y$ (with y close to 2) are ensured by the addition of agents that do not affect the quality of the films. The electrodeposited precursor film contains the elements in a composition close to I-III-$VI_2$ stoichiometry. The compositions and the morphology are controlled during the electrolysis. These agents (excess Se(IV) or $H_2O_2$) may be readily used for any type of electrolysis bath for electrodepositing I-III-VI systems such as Cu—In—Ga—Al—Se—S.

The conversion efficiencies obtained (9% without a surface antireflection film) attest to the quality of the deposits obtained by the method according to the invention.

Of course, the present invention is not limited to the embodiment described above by way of example; rather it extends to other alternative embodiments.

Thus, it will be understood that the elements I and III initially introduced into the solution in $CuSO_4$ and $In_2(SO_4)_3$ form may advantageously be introduced rather in the form of copper and indium oxides or hydroxides in order to limit contamination of the bath.

The invention claimed is:

1. A method of producing a I-III-$V_y$, compound in thin film form by electrochemistry, in which y is close to 2, VI is an element comprising selenium, I is copper, silver or gold and III is boron, aluminum, gallium, indium or thallium, comprising:

a) providing an electrolysis bath comprising active selenium, in oxidation state IV (Se(IV)), and at least two electrodes;

b) applying a potential difference between the two electrodes to promote migration of the active selenium toward one of the electrodes and initiate formation of at least one thin film of the I-III-$VI_y$, compound; and, c) regenerating the selenium in active form (Se(IV)) in the electrolysis bath.

2. The method of claim 1, wherein, at step c), an oxidizing agent for selenium is introduced into the electrolysis bath in order to regenerate the selenium in active form.

3. The method of claim 2, wherein when the electrolysis bath contains selenium in colloid form (Se(0)) at step b), the oxidizing agent regenerates the selenium in the colloid form to selenium in the active form.

4. The method of claim 2, wherein the oxidizing agent is hydrogen peroxide ($H_2O_2$).

5. The method of claim 4, wherein the hydrogen peroxide is added to the electrolysis bath in a concentration at least approximately five times an initial selenium concentration in the electrolysis bath.

6. The method of claim 1, wherein, at step c), selenium is added to the electrolysis bath in order to form an excess of active selenium in the electrolysis bath.

7. The method of claim 1, wherein, when one tenth of a concentration of selenium at step a) is consumed by producing the thin film at step b), approximately twice the consumed concentration of selenium is added to the bath at step c).

8. The method of claim 1, wherein, after step c), at least one new thin film of the I-III-$VI_y$ compound is formed.

9. The method of claim 1, wherein, the at least one thin film of the I-III-$VI_y$ compound is $CuInSe_y$ and the bath further comprises, at step a), for one unit of concentration of copper in the electrolysis bath, about 1.7 units of concentration of the active selenium.

10. The method of claim 1, further comprising step d), regenerating the electrolysis bath by introducing oxides and/or hydroxides of elements I and III wherein, the oxide is $In_2O_3$ and the hydroxide is $In(OH)_3$, or wherein the oxide is CuO and the hydroxide is $Cu(OH)_2$.

* * * * *